US006179413B1

(12) United States Patent
Coulman et al.

(10) Patent No.: US 6,179,413 B1
(45) Date of Patent: Jan. 30, 2001

(54) HIGH DURABILITY POLYMIDE-CONTAINING PRINTHEAD SYSTEM AND METHOD FOR MAKING THE SAME

(75) Inventors: Donald J. Coulman; Qin Liu, both of Corvallis, OR (US); Kit C. Baughman, Escondido, CA (US); Paul H. McClelland, Monmouth, OR (US); Douglas A. Sexton, San Diego, CA (US)

(73) Assignee: Hewlett-Packard Company, Palo Alto, CA (US)

( * ) Notice: Under 35 U.S.C. 154(b), the term of this patent shall be extended for 0 days.

(21) Appl. No.: 08/962,418

(22) Filed: Oct. 31, 1997

(51) Int. Cl.[7] ..... B41J 2/05
(52) U.S. Cl. ..... 347/63
(58) Field of Search ..... 347/63, 64, 65, 347/44, 47, 20

(56) References Cited

U.S. PATENT DOCUMENTS

| | | | | |
|---|---|---|---|---|
| 3,958,255 | | 5/1976 | Chiou et al. . | |
| 4,329,698 | | 5/1982 | Smith . | |
| 4,368,476 | | 1/1983 | Uehara et al. . | |
| 4,500,895 | | 2/1985 | Buck et al. . | |
| 4,643,948 | | 2/1987 | Diaz et al. . | |
| 4,663,640 | | 5/1987 | Ikeda . | |
| 4,725,862 | * | 2/1988 | Matsuzaki | 347/84 |
| 4,749,291 | | 6/1988 | Kobayashi et al. . | |
| 4,771,295 | | 9/1988 | Baker et al. . | |
| 4,847,639 | | 7/1989 | Sugata et al. . | |
| 4,944,850 | | 7/1990 | Dion . | |
| 5,063,125 | * | 11/1991 | Yuh et al. | 430/58.75 |
| 5,189,787 | | 3/1993 | Reed et al. . | |
| 5,198,834 | | 3/1993 | Childers et al. | 346/1.1 |
| 5,229,785 | * | 7/1993 | Leban | 347/47 |
| 5,278,584 | | 1/1994 | Keefe et al. . | |
| 5,305,015 | | 4/1994 | Schantz et al. . | |
| 5,353,045 | * | 10/1994 | Sako | 347/200 |
| 5,426,458 | | 6/1995 | Wenzel et al. . | |
| 5,665,249 | * | 9/1997 | Burke et al. | 216/2 |
| 5,680,702 | | 10/1997 | Kataoka | 29/890.1 |
| 5,874,974 | * | 2/1999 | Courian et al. | 347/65 |
| 5,994,425 | * | 11/1999 | Narang et al. | 522/35 |

FOREIGN PATENT DOCUMENTS

| | | | |
|---|---|---|---|
| 0752312A1 | 1/1997 | (EP) | B41J/2/045 |
| 0761448A2 | 3/1997 | (EP) | B41J/2/16 |
| 0787588A2 | 8/1997 | (EP) | B41J/2/04 |
| 0867294A2 | 9/1998 | (EP) | B41J/2/16 |
| 10016229 | 1/1988 | (JP) | B41J/2/05 |

OTHER PUBLICATIONS

Elliott, D.J., *Integrated Circuit Fabrication Technology*, McGraw–Hill Book Company, New York, 1982, pp. 1–41.
Tamai, S., "Melt Processible Polyimides and Their Chemical Structures", *Polymer*, 37(16) :3683–3692 (1996).
Yasuda, H., *Plasma Polymerization*, Academic Press, Inc. (1985), pp. 344–345, 354–355, 360–363, and 370–371.
Odian, G., *Principles of Polymerization*, 3rd ed., John Wiley & Sons, Inc., New York (1991), pp. 29–30.

* cited by examiner

*Primary Examiner*—John Barlow
*Assistant Examiner*—Michael S. Brooke

(57) ABSTRACT

A high-durability printhead for an ink cartridge printing system. The printhead includes a substrate having ink ejectors (e.g. resistors) thereon and an orifice plate positioned above the substrate. The orifice plate has a top surface, bottom surface, and a plurality of openings therethrough. The orifice plate is optimally produced from a non-metallic organic polymeric composition. To improve the durability, heat-stability, and ink resistance of the printhead, an intermediate layer manufactured from a thermoplastic polyimide is employed between the orifice plate and the ink ejector-containing substrate. This particular system generally improves the structural integrity of the printhead and provides longer cartridge life.

11 Claims, 2 Drawing Sheets

HIGH DURABILITY POLYMIDE-CONTAINING PRINTHEAD SYSTEM AND METHOD FOR MAKING THE SAME

BACKGROUND OF THE INVENTION

The present invention generally relates to printing technology, and more particularly involves an improved, high-durability printhead system for use in an ink cartridge (e.g. a thermal inkjet system).

Substantial developments have been made in the field of electronic printing technology. Specifically, a wide variety of highly-efficient printing systems currently exist which are capable of dispensing ink in a rapid and accurate manner. Thermal inkjet systems are especially important in this regard. Printing systems using thermal inkjet technology basically involve a cartridge which includes at least one ink reservoir chamber in fluid communication with a substrate having a plurality of resistors thereon. Selective activation of the resistors causes thermal excitation of the ink and expulsion of the ink from the cartridge. Representative thermal inkjet systems are discussed in U.S. Pat. No. 4,500,895 to Buck et al.; U.S. Pat. No. 4,771,295 to Baker et al.; U.S. pat. No. 5,278,584 to Keefe et al.; and the *Hewlett-Packard Journal*, Vol. 39, No. 4 (August 1988), all of which are incorporated herein by reference.

In order to effectively deliver ink materials to a selected substrate, thermal inkjet printheads typically include an outer plate member known as an "orifice plate" or "nozzle plate" which includes a plurality of ink ejection orifices (e.g. openings) therethrough. Initially, these orifice plates were manufactured from one or more metallic compositions including but not limited to gold-plated nickel and similar materials. However, recent developments in thermal inkjet printhead design have resulted in the production of orifice plates which are non-metallic in character, with the term "non-metallic" being defined to involve one or more material layers which are devoid of elemental metals, metal amalgams, or metal alloys. In a preferred embodiment, these non-metallic orifice plates are produced from a variety of different organic polymers including but not limited to film products consisting of polytetrafluoroethylene (e.g. Teflon®), non-thermoplastic polyimide, polymethylmethacrylate, polycarbonate, polyester, polyamide, polyethyleneterephthalate, and mixtures thereof. A representative polymeric (e.g. non-thermoplastic polyimide-based) composition which is suitable for this purpose is a commercial product sold under the trademark "KAPTON" by E.I. DuPont de Nemours and Company of Wilmington, Del. (USA). Orifice plate structures produced from the non-metallic compositions described above are typically uniform in thickness, with an average thickness range of about 1.0–2.0 mil. Likewise, they provide numerous benefits ranging from reduced production costs to a substantial simplification of the printhead structure which translates into improved reliability, economy, and ease of manufacture. The fabrication of film-type, non-metallic orifice plates and the corresponding production of the entire printhead structure is typically accomplished using conventional tape automated bonding ("TAB") technology as generally discussed in U.S. Pat. No. 4,944,850 to Dion. Likewise, further detailed information regarding polymeric, non-metallic orifice plates of the type described above is discussed in the following U.S. patents: U.S. Pat. No. 5,278,584 to Keefe et al. and No. 5,305,015 to Schantz et al.

However, a primary consideration in the selection of any materials to be used in the production of an ink cartridge printhead is the overall durability of the completed structure. The term "durability" as used herein shall encompass a wide variety of characteristics including but not limited to stability over a wide range of temperatures, as well as resistance to the "solvent effects" caused by many ink compositions. Regarding solvent resistance, typical ink compositions include one or more solvents which can cause degradation, deterioration, and/or separation of the various printhead structures in the system described above. As a result, the overall life-span and operational effectiveness of the printhead are reduced when these problems occur. Similar problems can take place if the printhead structure is incapable of withstanding the high-temperature conditions which can be encountered during sustained use. Temperature increases within a thermal inkjet printhead will normally result from selective energization of the thin-film heating resistors on the silicon substrate which takes place during printhead operation. Increases in printhead temperature can also be caused by extraneous heat radiating from adjacent operating components in the printer unit. Under these conditions, internal separation and/or structural deformation of various printhead components (e.g. the barrier layer, orifice plate, and the like) may take place which can cause a variety of problems. Specifically, chemical and/or thermal deterioration of the component layers in a thermal inkjet printhead can cause either total failure of the printhead or a continuous deterioration in print quality/resolution over time. In this regard, heat and solvent resistance (as well as a high degree of overall structural integrity) are important factors in producing a completed ink cartridge printhead having a long life-span which is capable of producing clear and distinct images over prolonged time periods.

Prior to development of the present invention, a need existed for an improved durability ink cartridge printhead having an orifice plate preferably manufactured from a non-metallic organic polymer composition. Likewise, a need generally remained for a printhead having a high level of structural integrity and chemical/thermal stability. The present invention satisfies these goals in a unique manner by providing an ink cartridge printhead with a specially-designed internal structure that is characterized by improved durability levels (e.g. ink-resistance and thermal stability). Accordingly, the claimed invention represents a substantial advance in ink printing technology as discussed in detail below.

SUMMARY OF THE INVENTION

It is an object of the present invention to provide an improved ink cartridge printing system.

It is another object of the invention to provide an improved ink cartridge printing system which includes a specialized printhead that is characterized by a high level of heat resistance, resistance to the solvent effects of ink compositions, improved adhesion of the various printhead components, and a higher overall degree of structural integrity.

It is another object of the invention to provide an improved ink cartridge printing system which includes a high-durability printhead having a specialized barrier system (e.g. an intermediate layer) that enables the benefits listed above to be achieved.

It is further object of the invention to provide an improved ink cartridge printing system with a high-durability printhead which may be used in connection with many different ink cartridges including thermal inkjet units.

It is a still further object of the invention to provide an improved ink cartridge printing system with a high-durability printhead that is capable of being fabricated using mass production techniques in order to substantially reduce manufacturing costs.

It is a still further object of the invention to provide an improved ink cartridge printing system with a high-durability printhead which can be used effectively with many different ink compositions while avoiding solvent-based deterioration problems.

It is an even further object of the invention to provide an improved ink cartridge printing system with a high durability printhead that includes (1) a non-metallic, organic polymer-based orifice plate; (2) a substrate comprising at least one ink ejector thereon; and (3) an intermediate layer positioned between the orifice plate and the substrate which provides numerous benefits including improved structural integrity, enhanced heat resistance, and a high level of ink solvent resistance.

It is an even further object of the invention to provide a unique fabrication process in which the claimed printhead is manufactured in a rapid and efficient manner so that the desired goals can be achieved.

In accordance with the present invention, a specialized thermal inkjet printhead is provided which is characterized by a high level of durability and strength. These benefits result from the use of a unique intermediate layer located within the printhead (between the orifice plate and the underlying substrate) that is comprised of at least one thermoplastic polyimide composition, with this term being specifically defined below. Whether the thermoplastic polyimide intermediate layer functions as a traditional barrier layer, an adhesive layer, or both, it provides increased levels of structural integrity, thermal stability under varying temperature conditions, and improved resistance to chemical deterioration caused by ink compositions compared with conventional systems. The use of thermoplastic polyimides in this manner therefore involves a departure from traditional ink cartridge printing systems and represents an advance in the art of ink printing technology. The following discussion constitutes a brief summary of the claimed invention. More specific and comprehensive information will be presented below in the Detailed Description of Preferred Embodiments section.

In accordance with a preferred embodiment of the invention, an improved printhead structure is provided which basically involves an ink expulsion system comprising three main components. First, a substrate is employed which is typically made of silicon. The substrate has an upper surface comprising at least one ink ejector thereon. In a thermal inkjet system, multiple ink ejectors consisting of a plurality of thin-film heating resistors (e.g. of a tantalum-aluminum type) are positioned on the upper surface of the substrate. These resistors are used to selectively heat, vaporize, and expel ink materials from the completed printhead. As discussed further below in connection with thermal inkjet systems, the substrate likewise optimally includes a plurality of logic transistors and associated metallic traces (conductive pathways) thereon which electrically communicate with the resistors so that they may be heated on-demand.

Fixedly positioned over and above the upper surface of the substrate having the ink ejector system thereon is an orifice plate member. In the present invention, the orifice plate member is preferably comprised of a non-metallic, organic polymer film composition. The term "non-metallic" as used herein shall involve a composition which does not contain any elemental metals, metal alloys, or metal amalgams. Likewise, "organic polymer" shall be defined to encompass a long-chain carbon-containing structure of repeating chemical subunits. Many different materials may be used for this purpose, with the claimed invention not being limited to any particular organic polymers. For example, the following compositions involve representative organic polymers which may be employed to produce the orifice plate: polytetrafluoroethylene (e.g. Teflon®), non-thermoplastic polyimide, polymethylmethacrylate, polycarbonate, polyester, polyamide, polyethyleneterephthalate, and mixtures thereof. The use of a film-type organic polymer for the orifice plate in the claimed invention provides numerous benefits compared with traditional metal orifice plates. These benefits include a reduction in material costs and improved manufacturing efficiency. In particular, orifice plates fabricated from organic polymer compositions are well-suited for use in connection with tape automated bonding ("TAB") production methods as discussed below. The orifice plate also comprises a top surface, a bottom surface, and at least one opening (e.g. "orifice") passing entirely through the orifice plate, with each opening providing access to at least one of the ink ejectors (e.g. resistors) on the upper surface of the underlying substrate.

The third main element in the printhead involves the use of an intermediate layer positioned between the orifice plate and the substrate having the ink ejector(s) thereon. The intermediate layer (also known as a "barrier layer" or "adhesive layer") is specifically designed to (1) provide protective insulation between the orifice plate and the substrate; (2) define a plurality of ink flow channels and ink vaporization chambers directly adjacent to and above the ink ejectors (e.g. resistors); and/or (3) provide adhesion of the orifice plate member to the underlying substrate and vice versa. As a result, effective and site-specific ink delivery to the resistors in the printhead may be accomplished.

In accordance with a preferred embodiment of the claimed invention, a thermoplastic polyimide composition is specifically used to produce the intermediate layer in the claimed printhead structure. Thermoplastic polyimides are structurally and functionally different from polyimide compounds that are non-thermoplastic (e.g. "thermosetting"). In particular, the term "thermoplastic polyimide" is defined to involve a polyimide compound that is capable of being repeatedly softened by heating and thereafter hardened by cooling through a characteristic temperature range. In a softened state, these materials can be shaped as desired using standard molding or extrusion processes. The use of this material as an intermediate (e.g. barrier) layer in the claimed printhead represents a substantial departure from conventional production methods. In particular, the unique chemical character of thermoplastic polyimide compositions provides enhanced durability levels in the completed printhead. For the purposes of this invention, the term "durability" shall again include but not be limited to (1) an improved degree of adhesion between the intermediate layer and the other adjacent components in the printhead [e.g. the orifice plate and substrate] which results in greater overall structural integrity; (2) improved thermal stability [e.g. heat-resistance] which avoids problems associated with deformation and premature separation of the printhead components; and (3) a greater degree of resistance to "solvation effects" caused by various ink compositions which, if not prevented, can cause chemical deterioration of the printhead and its individual components. All of these benefits are achieved in the various embodiments of the claimed invention through the use of thermoplastic polyimides which are distinguishable from non-thermoplastic polyimides in both structural and functional characteristics as noted above.

The thermoplastic polyimide intermediate layer may be directly deposited onto either the bottom surface of the orifice plate or the upper surface of the ink ejector-containing substrate during production of the printhead, followed by etching of the intermediate layer as needed and desired using conventional techniques (also described below). Likewise, many different methods and processing sequences can be used to form the thermoplastic polyimide intermediate layer, with the claimed invention not being restricted to any particular manufacturing/deposition techniques. For example, as discussed below, the application of this material to form the intermediate layer on the selected component(s) within the printhead may be achieved using a number of known procedures including but not limited to spin coating, extrusion coating, curtain coating, extrusion/spin coating combinations, roll coating, and thermal lamination which are generally known in the art for material deposition purposes. As previously noted, the thermoplastic polyimide intermediate layer may be applied and formed at any position between the orifice plate member and the substrate, and may likewise be applied at any stage during the printhead production process. Accordingly, the reaction sequence associated with this step can be varied based on the particular materials being processed and other parameters as determined by preliminary pilot testing.

The present invention shall also not be restricted to the use of any specific thermoplastic polyimide compositions in the intermediate layer (as well as thickness levels associated with the layer). However, a representative system designed to produce optimum results will utilize a thermoplastic polyimide intermediate layer having an overall uniform thickness of about 0.5–50 microns. Likewise, preferred thermoplastic polyimides will have a glass transition temperature [$T_g$] (defined below) of less than about 310° C. (optimally about 75–290° C.). Representative commercially-available thermoplastic polyimides having these characteristics which are suitable for use in the claimed printhead structure will be outlined below. In addition, the intermediate layer of the claimed invention may consist of either (A) a single thermoplastic polyimide material; (B) a mixture of more than one thermoplastic polyimide; or (C) a mixture of a thermoplastic polyimide and a non-thermoplastic polyimide. However, the present invention shall not be restricted to the use of any particular number, types, or weight ratios in connection with thermoplastic polyimide blends that are used to form the intermediate layer.

The completed printhead which includes the unique durability characteristics outlined above may then be used to produce a thermal inkjet cartridge of improved design and efficiency. This is initially accomplished by providing a housing comprising an ink-retaining compartment therein. The completed printhead having the features and components listed above is then affixed to the housing so that the printhead is in fluid communication with the compartment (and ink materials) within the housing. It is important to note that the claimed printhead, orifice plate, and benefits associated therewith are applicable to many different ink cartridges, with the present invention not being restricted to any particular cartridge designs or configurations.

Likewise, the basic production method associated with the invention represents an important development in ink cartridge technology which substantially improves the durability and structural integrity of the completed printhead and ink cartridge. In a preferred embodiment, this method involves (1) providing a thermal inkjet printhead as described above which includes a substrate (e.g. made of silicon) having an upper surface with at least one ink ejector thereon, and an orifice plate made of a non-metallic organic polymer positioned over and above the substrate, with the orifice plate having a top surface, bottom surface, and a plurality of openings therethrough; and (2) placing an intermediate layer between the upper surface of the substrate having the ink ejector(s) thereon and the bottom surface of the orifice plate, with the intermediate layer being comprised of at least one thermoplastic polyimide composition (defined above). The thermoplastic polyimide composition can involve a single compound or a blend of materials as previously noted. A representative system designed to produce optimum results will again utilize a thermoplastic polyimide intermediate layer having an overall uniform thickness of about 0.5–50 microns. Preferred thermoplastic polyimides will have a glass transition temperature [$T_g$] of less than about 310° C. (optimally about 75–290° C.). Also, representative materials suitable for producing the non-metallic orifice plate will include polytetrafluoroethylene, non-thermoplastic polyimide, polymethylmethacrylate, polycarbonate, polyester, polyamide, polyethyleneterephthalate, and mixtures thereof. Implementation of the basic method associated with the invention may be accomplished as described above or in accordance with routine modifications to the foregoing process which accomplish the same result. Thus, regardless of the steps which are used to produce the improved printhead structure, the claimed method represents an advance in the art of thermal inkjet technology.

In its broadest sense, the present invention involves the use of a material layer between the orifice plate and ink ejector-containing substrate which contains at least one thermoplastic polyimide composition. Whether this material layer constitutes a barrier layer used to define the ink flow passageways and vaporization chambers in the printhead or functions as a layer of adhesive material designed to secure the printhead together, the unique characteristics of thermoplastic polyimides within the completed printhead structure enable numerous benefits to be achieved. These benefits include: (1) an improved degree of adhesion regarding attachment of the internal printhead components to each other which leads to a greater level of overall structural integrity; (2) improved thermal stability and heat-resistance which avoids printhead deformation/delamination problems; (3) an enhanced level of resistance to the deterioration of printhead components caused by the solvent characteristics of ink materials; and (4) the maintenance of a high level of print quality over the life of the cartridge unit which is capable of providing long-term service without the problems listed above.

These and other objects, features, and advantages of the invention will be discussed below in the following Brief Description of the Drawings and Detailed Description of Preferred Embodiments.

DETAILED DESCRIPTION OF PREFERRED EMBODIMENTS

Figure 1:
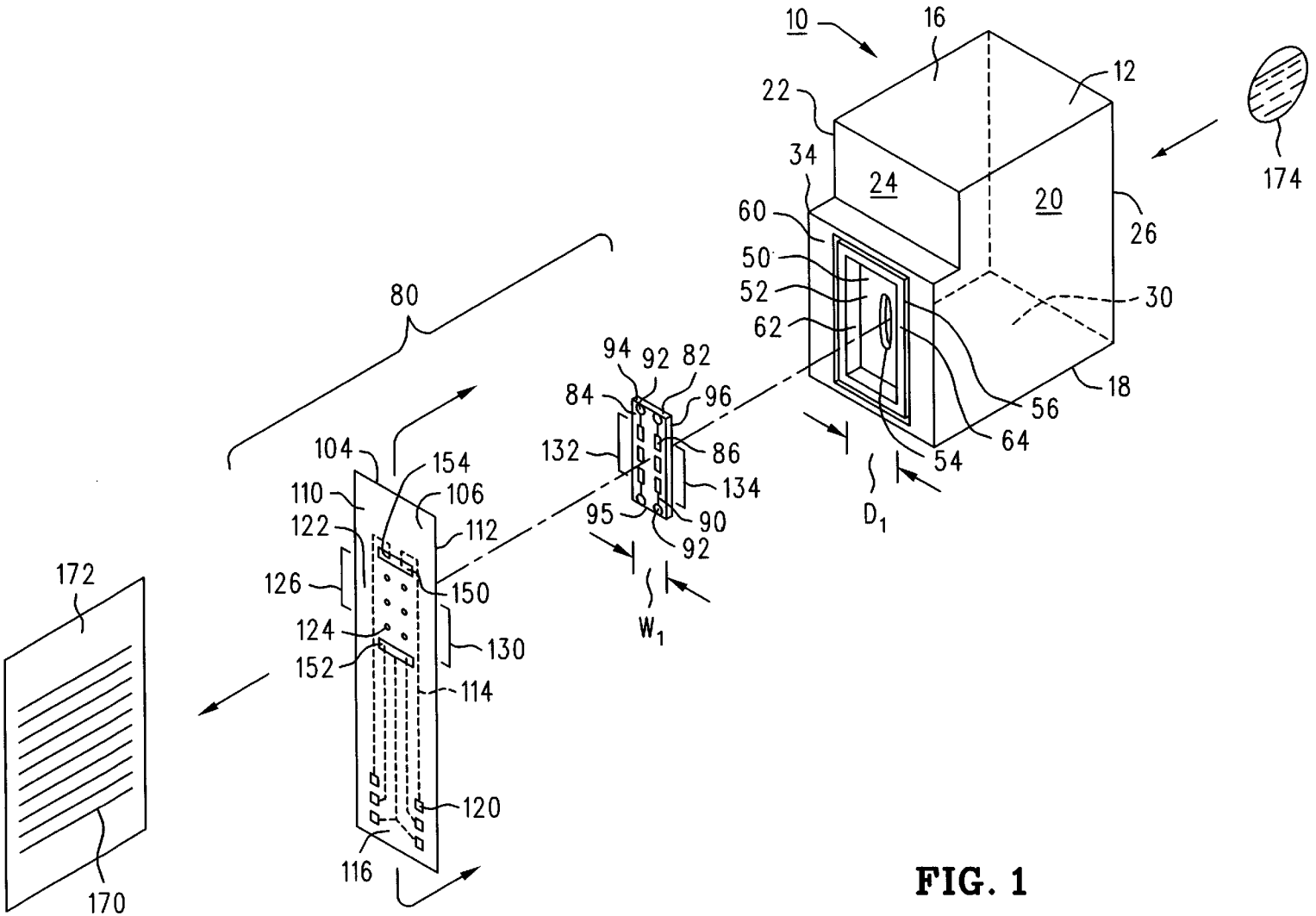
FIG. 1 is a schematic exploded illustration of a representative thermal inkjet cartridge unit which may be used in connection with the printhead and orifice plate of the present invention.

The present invention involves a unique printhead for an ink cartridge system which includes an orifice plate structure through which the ink passes. The ink is then delivered to a selected print media material (e.g. paper) using conventional inkjet printing techniques. In accordance with the invention, the claimed printhead system employs an orifice plate with multiple openings therethrough that is produced from a non-metallic, organic polymer film with specific examples being provided below. To improve the durability of entire printhead structure, an intermediate (e.g. underlying) layer of at least one thermoplastic polyimide composition is provided between the orifice plate and the ink ejector-containing substrate. These components cooperate to create a durable, long-life printhead in which a high level of print quality is maintained. Accordingly, as discussed below, the claimed printhead and manufacturing process represent a significant advance in ink printing technology.

A. A Brief Overview of Thermal Inkjet Technology and a Representative Cartridge Unit As noted above, the present invention is applicable to a wide variety of ink cartridge printheads which include (1) an upper orifice plate member having one or more openings therethrough; and (2) a substrate beneath the orifice plate member comprising at least one or more ink "ejectors" thereon or associated therewith. The term "ink ejector" shall be defined to encompass any type of component or system which selectively ejects or expels ink materials from the printhead through the plate member. Thermal inkjet printing systems which use multiple heating resistors as ink ejectors are preferred for this purpose. However, the present invention shall not be restricted to any particular type of ink ejector or inkjet printing system as noted above. Instead, a number of different inkjet devices may be encompassed within the invention including but not limited to piezoelectric drop systems of the general type disclosed in U.S. Pat. No. 4,329,698 to Smith, dot matrix systems of the variety described in U.S. Pat. No. 4,749,291 to Kobayashi et al., as well as other comparable and functionally equivalent systems designed to deliver ink using one or more ink ejectors. The specific ink-expulsion devices associated with these alternative systems (e.g. the piezoelectric elements in the system of U.S. Pat. No. 4,329,698) shall be encompassed within the term "ink ejectors" as discussed above. Accordingly, even though the present invention will be discussed herein with primary reference to thermal inkjet technology, it shall be understood that other systems are equally applicable and relevant to the claimed technology.

To facilitate a complete understanding of the present invention as it applies to thermal inkjet technology (which is the preferred system of primary interest), an overview of thermal inkjet technology will now be provided. It is important to emphasize that the claimed invention shall be not restricted to any particular type of thermal inkjet cartridge unit. Many different cartridge systems may be used in connection with the materials and processes of the invention. In this regard, the invention shall be prospectively applicable to any type of thermal inkjet system which uses a plurality of thin-film heating resistors mounted on a substrate as "ink ejectors" to selectively deliver ink materials, with the ink materials passing through an orifice plate having multiple openings therein. The ink delivery systems schematically shown in the drawing figures listed above are provided for example purposes only and are non-limiting.

With reference to FIG. 1, a representative thermal inkjet ink cartridge unit 10 is illustrated. This cartridge is of a general type shown and described in U.S. Pat. No. 5,278,584 to Keefe et al. and the *Hewlett-Packard Journal*, Vol. 39, No. 4 (August 1988), both of which are incorporated herein by reference. It is again emphasized that cartridge unit 10 is shown in schematic format, with more detailed information regarding cartridge unit 10 being provided in U.S. Pat. No. 5,278,584. As illustrated in FIG. 1, the cartridge unit 10 first includes a housing 12 which is preferably manufactured from plastic, metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 further includes a front wall 24 and a rear wall 26. Surrounded by the front wall 24, top wall 16, bottom wall 18, first side wall 20, second side wall 22, and rear wall 26 is an interior chamber or compartment 30 within the housing 12 (shown in phantom lines in FIG. 1) which is designed to retain a supply of ink therein as described below. The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment 30 through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64 which will likewise be described in greater detail below.

With continued reference to FIG. 1, fixedly secured to housing 12 of the ink cartridge unit 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). A discussion of these components and additional information concerning the printhead 80 are provided in U.S. Pat. No. 5,278,584 to Keefe et al. which again describes the ink cartridge unit 10 in considerable detail and is incorporated herein by reference. The first main component used to produce the printhead 80 consists of a substrate 82 preferably manufactured from silicon. Secured to the upper surface 84 of the substrate 82 using conventional thin film fabrication techniques is a plurality of individually energizable thin-film resistors 86 which function as "ink ejectors" and are preferably made from a tantalum-aluminum composition known in the art for resistor fabrication. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 which electrically communicate with the resistors 86. The conductive traces 90 also communicate with multiple metallic pad-like contact regions 92 positioned at the ends 94, 95 of the substrate 82 on the upper surface 84. The function of all these components which, in combination, are collectively designated herein as a resistor assembly 96 will be discussed further below. Many different materials and design configurations may be used to construct the resistor assembly 96, with the present invention not being restricted to any particular elements, materials, and components for this purpose. However, in a preferred, representative, and non-limiting embodiment discussed in U.S. Pat. No. 5,278,584 to Keefe et al., the resistor assembly 96 will be approximately 0.5 inches long and will likewise contain 300 resistors 86 thus enabling a resolution of 600 dots per inch ("DPI"). The substrate 82 containing the resistors 86 thereon will preferably have a width "$W_1$" (FIG. 1) which is less than the distance "$D_1$" between the side walls 62, 64 of the mounting frame 56. As a result, ink flow passageways 100, 102 (schematically shown in FIG. 2) are formed on both sides of the substrate 82 so that ink flowing from the ink outlet port 54 in the central cavity 50 can ultimately come in contact with the resistors 86 as discussed further below. It should also be noted that the substrate 82 may include a number of other components thereon (not shown) depending on the type of ink cartridge unit 10 under consideration. For example, the substrate 82 may likewise include a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contract regions 92 and traces 90) formed on the substrate 82. Other features of the substrate 82 (e.g. the resistor assembly 96) will be presented below.

Securely affixed to the upper surface 84 of the substrate 82 (with one or more intervening material layers therebetween as discussed below) is the second main component of the printhead 80. Specifically, an orifice plate 104 is provided as shown in FIG. 1 which is used to distribute the selected ink compositions to a designated print media material (e.g. paper). Prior orifice plate designs involved a rigid plate structure manufactured from an inert metal composition (e.g. gold-plated nickel). However, recent developments in thermal inkjet technology have resulted in the use of non-metallic, organic polymer films to construct the orifice plate 104 as generally noted in U.S. Pat. No. 5,278,584. With reference to FIG. 1, this type of orifice plate 104 will consist of a flexible film-type substrate 106 manufactured from a selected non-metallic organic polymer film having a uniform thickness of about 1.0–2.0 mil in a representative embodiment. For the purposes of this invention as discussed below, the term "non-metallic" shall involve a composition which does not contain any elemental metals, metal alloys, or metal amalgams. Likewise, the phrase "organic polymer" shall involve a long-chain carbon-containing structure of repeating chemical subunits. A number of different polymeric compositions may be employed for this purpose, with the present invention not being restricted to any particular construction materials. For example, the polymeric substrate 106 may be manufactured from the following compositions: polytetrafluoroethylene (e.g. Teflon®), non-thermoplastic polyimide, polymethylmethacrylate, polycarbonate, polyester, polyamide, polyethylene-terephthalate, or mixtures thereof. Likewise, a representative commercial organic polymer (e.g. non-thermoplastic polyimide-based) composition which is suitable for constructing the substrate 106 is a product sold under the trademark "KAPTON" by E.I. DuPont de Nemours and Company of Wilmington, Del. (USA). As shown in the schematic illustration of FIG. 1, the flexible orifice plate 104 is designed to "wrap around" the outwardly extending printhead support structure 34 in the completed ink cartridge unit 10.

Figure 3:
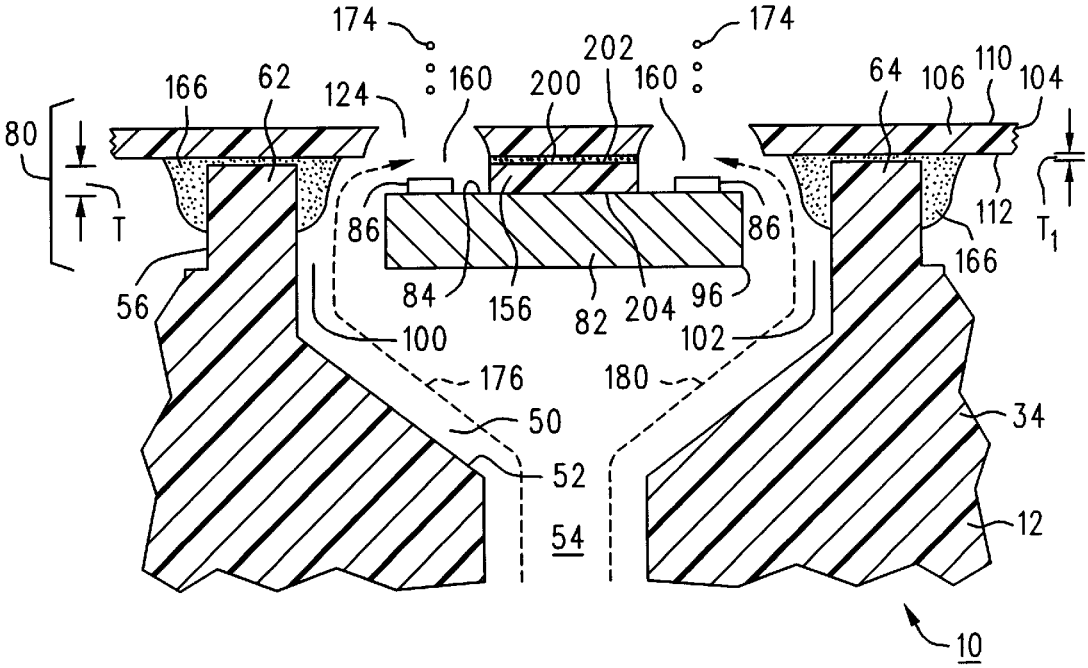
FIG. 3 is a schematic, enlarged cross-sectional view of an alternative embodiment of the printhead shown in FIG. 2.

The film-type substrate 106 (e.g. the orifice plate 104) further includes a top surface 110 and a bottom surface 112 (FIGS. 1 and 3). Formed on the bottom surface 112 of the substrate 106 and shown in dashed lines in FIG. 1 is a plurality of metallic (e.g. copper) circuit traces 114 which are applied to the bottom surface 112 using known metal deposition and photolithographic techniques. Many different circuit trace patterns may be employed on the bottom surface 112 of the film-type substrate 106 (orifice plate 104), with the specific pattern depending on the particular type of ink cartridge unit 10 and printing system under consideration. Also provided at position 116 on the top surface 110 of the substrate 106 is a plurality of metallic (e.g. gold-plated copper) contact pads 120. The contact pads 120 communicate with the underlying circuit traces 114 on the bottom surface 112 of the substrate 106 via openings or "vias" (not shown) through the substrate 106. During use of the ink cartridge unit 10 in a printer unit, the pads 120 come in contact with corresponding printer electrodes in order to transmit electrical control signals from the printer to the contact pads 120 and circuit traces 114 on the orifice plate 104 for ultimate delivery to the resistor assembly 96. Electrical communication between the resistor assembly 96 and the orifice plate 104 will be discussed below.

Positioned within the middle region 122 of the substrate 106 used to produce the orifice plate 104 is at least one or preferably multiple openings or orifices 124 which pass entirely through the substrate 104. These orifices 124 are shown in enlarged format in FIG. 1. Each orifice 124 in a representative embodiment will have a diameter of about 0.01–0.05 mm. In the completed printhead 80, all of the components listed above are assembled (discussed below) so that each of the orifices 124 is aligned with at least one of the resistors 86 (e.g. "ink ejectors") on the substrate 82. As result, energization of a given resistor 86 will cause ink expulsion from the desired orifice 124 through the orifice plate 104. The claimed invention shall not be limited to any particular size, shape, or dimensional characteristics in connection with the orifice plate 104 and shall likewise not be restricted to any number or arrangement of orifices 124. In a representative embodiment as presented in FIG. 1, the orifices 124 are arranged in two rows 126, 130 on the substrate 106. Likewise, if this arrangement of orifices 124 is employed, the resistors 86 on the resistor assembly 96 (e.g. the substrate 82) will also be arranged in two corresponding rows 132, 134 so that the rows 132, 134 of resistors 86 are in substantial registry with the rows 126, 130 of orifices 124.

Finally, as shown in FIG. 1, dual rectangular windows 150, 152 are provided at each end of the rows 126, 130 of orifices 124. Partially positioned within the windows 150, 152 are beam-type leads 154 which, in a representative embodiment, are gold-plated copper and constitute the terminal ends (e.g. the ends opposite the contact pads 120) of the circuit traces 114 positioned on the bottom surface 112 of the substrate 106/orifice plate 104. The leads 154 are designed for electrical connection by soldering, thermocompression bonding, and the like to the contact regions 92 on the upper surface 84 of the substrate 82 associated with the resistor assembly 96. Attachment of the leads 154 to the contact regions 92 on the substrate 82 is facilitated during mass production manufacturing processes by the windows 150, 152 which enable immediate access to these components. As a result, electrical communication is established from the contact pads 120 to the resistor assembly 96 via the circuit traces 114 on the orifice plate 104. Electrical signals from the printer unit (not shown) can then travel via the conductive traces 90 on the substrate 82 to the resistors 86 so that on-demand heating (energization) of the resistors 86 can occur.

At this point, it is important to briefly discuss fabrication techniques in connection with the structures described above which are used to manufacture the printhead 80. Regarding the orifice plate 104, all of the openings therethrough including the windows 150, 152 and the orifices 124 are typically formed using conventional laser ablation techniques as again discussed in U.S. Pat. No. 5,278,584 to Keefe et al. Specifically, a mask structure initially produced using standard lithographic techniques is employed for this purpose. A laser system of conventional design is then selected which, in a preferred embodiment, involves an excimer laser of a type selected from the following alternatives: $F_2$, ArF, KrCl, KrF, or XeCl. Using this particular system (along with preferred pulse energies of greater than about 100 millijoules/$cm^2$ and pulse durations shorter than about 1 microsecond), the above-listed openings (e.g. orifices 124) can be formed with a high degree of accuracy, precision, and control. However, the claimed invention shall not be limited to any particular fabrication method, with other methods also being suitable for producing the completed orifice plate 104 including conventional ultraviolet ablation processes (e.g. using ultraviolet light in the range of about 150–400 nm), as well as standard chemical etching, stamping, reactive ion etching, ion beam milling, and other known processes.

After the orifice plate 104 is produced as discussed above, the printhead 80 is completed by attaching the resistor assembly 96 (e.g. the substrate 82 having the resistors 86 thereon) to the orifice plate 104. In a preferred embodiment, fabrication of the printhead 80 is accomplished using tape automated bonding ("TAB") technology. The use of this particular process to produce the printhead 80 is again discussed in considerable detail in U.S. Pat. No. 5,278,584. Likewise, background information concerning TAB technology is also generally provided in U.S. Pat. No. 4,944,850 to Dion. In a TAB-type fabrication system, the processed substrate 106 (e.g. the completed orifice plate 104) which has already been ablated and patterned with the circuit traces 114 and contact pads 120 actually exists in the form of multiple, interconnected "frames" on an elongate "tape", with each "frame" representing one orifice plate 104. The tape (not shown) is thereafter positioned (after cleaning in a conventional manner to remove impurities and other residual materials) in a TAB bonding apparatus having an optical alignment sub-system. Such an apparatus is well-known in the art and commercially available from many different sources including but not limited to the Shinkawa Corporation of Japan (model no. IL-20). Within the TAB bonding apparatus, the substrate 82 associated with the resistor assembly 96 and the orifice plate 104 are properly oriented so that (1) the orifices 124 are in precise alignment with the resistors 86 on the substrate 82; and (2) the beam-type leads 154 associated with the circuit traces 114 on the orifice plate 104 are in alignment with and positioned against the contact regions 92 on the substrate 82. The TAB bonding apparatus then uses a "gang-bonding" method (or other similar procedures) to press the leads 154 onto the contact regions 92 (which is accomplished through the open windows 150, 152 in the orifice plate 104). The TAB bonding apparatus thereafter applies heat in accordance with conventional bonding processes in order to secure these components together. It is also important to note that other standard bonding techniques may likewise be used for this purpose including but not limited to ultrasonic bonding, conductive epoxy bonding, solid paste application processes, and other similar methods. In this regard, the claimed invention shall not be restricted to any particular processing techniques associated with the printhead 80.

Figure 2:
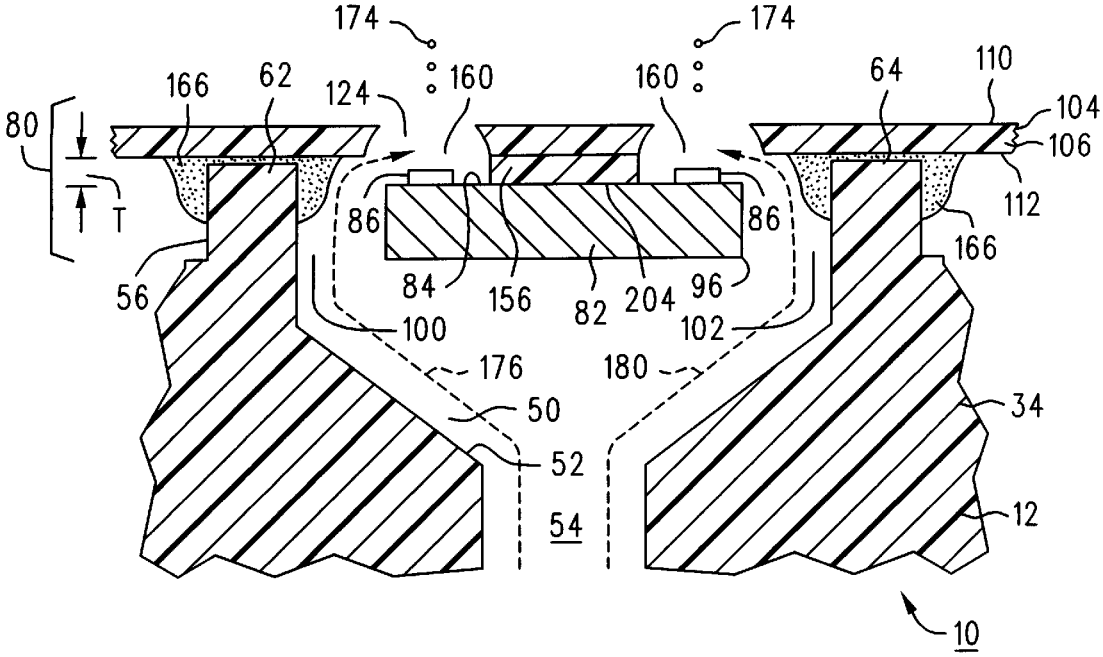
FIG. 2 is a schematic, enlarged cross-sectional view of the printhead associated with the thermal inkjet cartridge unit of FIG. 1 wherein the thermoplastic polyimide intermediate layer of the invention is illustrated.

As previously noted in connection with the conventional cartridge unit 10 in FIG. 1, one or more additional layers of material are typically present between the orifice plate 104 and resistor assembly 96 (e.g. substrate 82 with the resistors 86 thereon). These additional layers perform various functions including electrical insulation, adhesion of the orifice plate 104 to the resistor assembly 96, and the like. With reference to FIG. 2, the printhead 80 is illustrated in cross-section after attachment to the housing 12 of the cartridge unit 10, with attachment of these components being discussed in further detail below. As shown in FIG. 2, the upper surface 84 of the substrate 82 likewise includes an intermediate layer 156 thereon which covers the conductive traces 90 (FIG. 1), but is positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104 as indicated below. The intermediate layer 156 in the present invention is produced from a special material with beneficial capabilities which represent an important and novel technological development as outlined in the next section.

During the TAB bonding process discussed above, the printhead 80 (which includes the previously-described components) is ultimately subjected to heat and pressure within a heating/pressure-exerting station in the TAB bonding apparatus. This step (which may likewise be accomplished using other heating methods including external heating of the printhead 80) causes thermal adhesion of the internal components together. As a result, the printhead assembly process is completed at this stage.

The only remaining step involves cutting and separating the individual "frames" on the TAB strip (with each "frame" comprising an individual, completed printhead 80), followed by attachment of the printhead 80 to the housing 12 of the ink cartridge unit 10. Attachment of the printhead 80 to the housing 12 may be accomplished in many different ways. However, in a preferred embodiment illustrated schematically in FIG. 2, a portion of adhesive material 166 may be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1). Representative adhesive materials suitable for this purpose include commercially available epoxy resin and cyanoacrylate adhesives known in the art. During the affixation process, the substrate 82 associated with the resistor assembly 96 is precisely positioned within the central cavity 50 as illustrated in FIG. 2 so that the substrate 82 is located within the center of the mounting frame 56 (discussed above and illustrated in FIG. 2). In this manner, the ink flow passageways 100, 102 (FIG. 2) are formed which enable ink materials to flow from the ink outlet port 54 within the central cavity 50 into the vaporization chambers 160 for expulsion from the cartridge unit 10 through the orifices 124 in the orifice plate 104.

To generate a printed image 170 on a selected image-receiving medium 172 (e.g. paper) using the cartridge unit 10, a supply of a selected ink composition 174 (schematically illustrated in FIG. 1) which resides within the interior compartment 30 of the housing 12 passes into and through the ink outlet port 54 within the bottom wall 52 of the central cavity 50. The ink composition 174 thereafter flows into and through the ink flow passageways 100, 102 in the direction of arrows 176, 180 toward the substrate 82 having the resistors 86 thereon (e.g. the resistor assembly 96). The ink composition 174 then enters the vaporization chambers 160 directly above the resistors 86. Within the chambers 160, the ink composition 174 comes in contact with the resistors 86. To activate (e.g. energize) the resistors 86, the printer system (not shown) which contains the cartridge unit 10 causes electrical signals to travel from the printer unit to the contact pads 120 on the top surface 110 of the substrate 106 associated with the orifice plate 104. The electrical signals then pass through vias (not shown) within the plate 104 and subsequently travel along the circuit traces 114 on the bottom surface 112 of the plate 104 to the resistor assembly 96 containing the resistors 86. In this manner, the resistors 86 can be selectively energized (e.g. heated) in order to cause ink vaporization and expulsion from the printhead 80 via the orifices 124 through the orifice plate 104. The ink composition 174 can then be delivered in a highly selective, on-demand basis to the selected image-receiving medium 172 to generate an image 170 thereon (FIG. 1).

It is important to emphasize that the printing process discussed above is applicable to a wide variety of different thermal inkjet cartridge designs. In this regard, the inventive concepts outlined below shall not be restricted to any particular printing system. However, a representative, non-limiting example of a thermal inkjet cartridge of the type described above which may be used in connection with the claimed invention involves an inkjet cartridge sold by the Hewlett-Packard Company of Palo Alto, Calif. (USA) under the designation "51645A." Likewise, further details concerning thermal inkjet processes in general are summarized in the *Hewlett-Packard Journal*, Vol. 39, No. 4 (August 1988), U.S. Pat. No. 4,500,895 to Buck et al., and U.S. Pat. No. 4,771,295 to Baker et al. Having discussed conventional thermal inkjet components and printing methods associated therewith, the claimed invention and its beneficial features will now be presented.

B. The Printhead Structure of the Present Invention

As previously noted, the claimed invention enables the production of an orifice plate and a thermal inkjet printhead with an improved level of durability. The term "durability" again involves a variety of important characteristics including but not limited to stability over a wide range of temperatures, as well as resistance to the "solvent effects" caused by many ink compositions. Regarding solvent resistance, typical ink compositions include one or more solvents (e.g. ethylene glycol, 1,5-pentanediol, 2-pyrrolidone, and the like) which can cause degradation, deterioration, and/or internal separation of the various printhead structures. As a result, the overall life-span and operational effectiveness of the printhead are reduced when these difficulties occur. Similar problems can take place if the printhead structure is incapable of withstanding the high-temperature conditions which can result during sustained use. Temperature increases within a thermal inkjet printhead will normally result from selective energization of the thin-film heating resistors on the silicon substrate which takes place during printhead operation. Likewise, increases in printhead temperature can also be caused by extraneous heat radiating from adjacent operating components in the printer unit. Under these conditions, internal separation and/or structural deformation of various printhead components (e.g. the barrier layer, orifice plate, and the like) may take place which can cause multiple problems. Specifically, chemical and/or thermal deterioration of the component layers in a thermal inkjet printhead can result in total failure of the printhead or a continuous deterioration in print quality/resolution over time. In this regard, heat and solvent resistance (as well as a high degree of overall structural integrity) are important factors in producing a completed ink cartridge printhead having a long life-span which is capable of producing clear and distinct images over prolonged time periods.

With reference to FIG. 2, an enlarged, schematically-illustrated view of the thermal inkjet printhead 80 produced in accordance with a preferred embodiment of the invention is illustrated. Reference numbers in FIG. 2 (and FIG. 3) which correspond with those in FIG. 1 signify parts, components, and elements that are common to the printheads shown in these figures. Such common elements are discussed above in connection with the printhead 80 of FIG. 1, with the discussion of these elements being incorporated by reference in FIGS. 2 and 3. At this point, it is again important to emphasize that the substrate 106 used to produce the orifice plate 104 in the embodiments of FIGS. 1–3 is non-metallic (e.g. non-metal-containing) and consists of a selected organic polymer film. The term "non-metallic" shall involve a composition which does not contain any elemental metals, metal alloys, or metal amalgams. Likewise, the term "organic polymer" shall encompass a long-chain carbon-containing structure of repeating chemical subunits. Representative organic polymers suitable for producing the substrate 106 associated with the orifice plate 104 in the embodiments of FIGS. 1–3 include polytetrafluoroethylene (e.g. Teflon®), non-thermoplastic polyimide, polymethylmethacrylate, polycarbonate, polyester, polyamide, polyethylene-terephthalate, or mixtures thereof. Likewise, a representative commercial organic polymer (e.g. a non-thermoplastic polyimide-based composition) which may be used for this purpose is a product sold under the trademark "KAPTON" by E.I. DuPont de Nemours and Company of Wilmington, Del. (USA).

As shown in FIG. 2, an intermediate layer 156 of material is provided between and secured to the upper surface 84 of the substrate 82 and the bottom surface 112 of the orifice plate 104. This intermediate layer 156 primarily functions as a "barrier layer" designed to be positioned between and around the resistors 86 without covering them. As a result, an ink vaporization chamber 160 (FIG. 2) is formed directly above each resistor 86. Within each chamber 160, ink materials are heated, vaporized, and subsequently expelled through the orifices 124 in the orifice plate 104 as indicated above. In addition to or instead of the "barrier" function, the intermediate layer 156 can function as an "adhesion layer" securing the orifice plate 104 to the underlying substrate 82. In conventional printhead systems, the intermediate (e.g. barrier) layer 156 was produced from, for example, the following materials: 1) dry photoresist films containing half acrylol esters of bis-phenol; 2) epoxy monomers; 3) acrylic and melamine monomers [e.g. which are sold under the trademark "VACREL" by E.I. DuPont de Nemours and Company of Wilmington, Del. (USA)]; and 4) epoxy-acrylate monomers [e.g. which are sold under the trademark "PARAD" by E.I. DuPont de Nemours and Company of Wilmington, Del. (USA)]. Barrier technology is likewise generally discussed in U.S. Pat. No. 5,278,584 to Keefe et al. which is incorporated herein by reference. However, a totally different composition is employed to produce the intermediate layer 156 in the claimed invention, with this material providing the benefits listed above. The special material used to fabricate the intermediate layer 156 will now be described in detail.

With continued reference to FIG. 2, the intermediate layer 156 is manufactured from at least one thermoplastic polyimide composition. The term "thermoplastic polyimide" shall be defined herein to involve a polyimide compound that is capable of being repeatedly softened by heating and thereafter hardened by cooling. In a softened state, this material can be shaped as desired using standard molding or extrusion processes. Likewise, this material can also be shaped in a non-softened state using conventional photolithographic processes. These capabilities are not evident in non-thermoplastic or polyimides which cannot be repeatedly softened and hardened as noted above. The use of a thermoplastic polyimide in the intermediate (e.g. barrier/adhesion) layer 156 represents a substantial departure from conventional production methods. In particular, the unique physical/chemical character of thermoplastic polyimide compositions (which are dissimilar to non-thermoplastic polyimides in structure and function) provides enhanced durability levels in the completed printhead 80. For the purposes of this invention, the term "durability" shall again include but not be limited to (1) an improved degree of adhesion between the intermediate layer 156 and the other adjacent components in the printhead 80 [e.g. the orifice plate 104 and substrate 82] which results in greater overall structural integrity; (2) improved thermal stability [e.g. heat-resistance] which avoids problems associated with deformation and premature separation of the printhead components; and (3) a greater degree of resistance to "solvation effects" caused by ink compositions which, if not prevented, can cause chemical deterioration of the printhead 80 and its individual components. All of these benefits are achieved in the various embodiments of the claimed invention through the use of thermoplastic polyimides which are again distinguishable from non-thermoplastic polyimides in both structural and functional characteristics as noted above.

Polyimides basically involve the following general chemical structure which appears in Tamai, S., et al., "Melt Processible Polyimides and their Chemical Structures", *Polymer,* 37(16): 3683–3692 (1996) which is incorporated herein by reference:

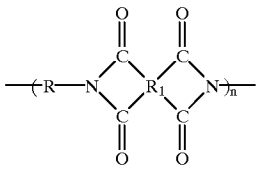

[wherein n is greater than one and both R and $R_1$ involve organic groups of variable structure (see the examples below)].

Regarding specific thermoplastic polyimides, the structures of such materials are traditionally proprietary. However, representative examples of commercially available thermoplastic polyimide materials suitable for use in the claimed product and method involve the following commercial products: (1) PROBIMIDE® sold by Olin Microelectronic Materials of Providence, R.I. (USA); (2) LaRC™-SI sold by IMITEC, Inc. of Schenectady, N.Y. (USA); and (3) REGULUS® by Mitsui Toatsu Chemicals, Inc. of Purchase, N.Y. (USA). Likewise, additional thermoplastic polyimide compositions which may be employed in the claimed printhead 80 are discussed in extensive detail in Tamai, S., et al., "Melt Processible Polyimides and their Chemical Structures", *Polymer*, 37(16): 3683–3692 (1996) as cited above which is again incorporated herein by reference. These polyimide compositions are produced using the following monomeric starting materials which are subsequently polymerized (discussed further below):

(A) 4,4'-bis(3-aminophenoxy)diphenyl;

(B) 4,4'-bis(3-aminophenoxy)diphenylsulfone;

(C) 4,4'-bis(3-aminophenoxy)diphenylsulfide;

(D) 4,4'-bis(4-aminophenoxy)diphenyl;

(E) 4,4'-bis(4-aminophenoxy)diphenylsulfone;

(F) 4,4'-bis(4-aminophenoxy)diphenylether;

(G) 4,4'-bis(4-aminophenoxy)diphenylsulfide; and others as recited in the Tamai et al. reference. Thermoplastic polyimides are prepared from these materials by combining one or more of the foregoing compounds with a selected tetracarboxylic dianhydride [e.g. 3,3',4,4'-diphenylether tetracarboxylic dianhydride or 2,2-bis(3,4-dicarboxyphenyl)-1,1,1,3,3,3-hexaflouropropane dianhydride] to yield the desired polymer (e.g. thermoplastic polyimide) as outlined in Tamai et al.

However, the present invention shall not be restricted to the use of any particular thermoplastic polyimides, with a number of different commercial products being applicable. The invention shall also not be limited to the use of any specific thickness levels associated with the intermediate layer 156. However, a representative system designed to produce optimum results will utilize a thermoplastic polyimide intermediate layer 156 having an overall uniform thickness "T" (FIG. 2) of about 0.5–50 microns. Likewise, preferred thermoplastic polyimides suitable for use in the printhead 80 will have a glass transition temperature [$T_g$] of less than about 310° C. (optimally about 75–290° C.). The commercial products listed above represent exemplary thermoplastic polyimides having $T_g$ values which fall within the foregoing 75–290° C. range (and are likewise less than about 310° C.). The term "glass transition temperature" shall be defined to involve the temperature at which a dramatic change occurs in the local movement of polymer chains which leads to large changes in a host of physical properties. More specifically, in accordance with a standard definition provided in Odian, G., *Principles of Polymerization*, 3rd ed., John Wiley & Sons, Inc., New York (1991), p. 29–30, the glass transition temperature will involve the temperature at which the selected thermoplastic polyimide becomes "glassy" with a stiff and rigid character. The above-listed glass transition temperature values are desirable and preferred in the present case because they provide a good balance between processing requirements and performance. However, the claimed invention shall not be restricted to any particular physical characteristics in connection with the selected thermoplastic polyimides, with a number of different thermoplastic polyimides being suitable for use herein.

The thermoplastic polyimide intermediate layer 156 may be directly deposited onto either the bottom surface 112 of the orifice plate 104 or the upper surface 84 of the ink ejector-containing substrate 82 during production of the printhead 80, followed by etching of the intermediate layer 156 as needed and desired using conventional techniques [e.g. photolithographic processes and other procedures known in the art as discussed in Eliott, D. J., *Integrated Circuit Fabrication Technology*, McGraw-Hill Book Co., New York, 1982 (ISBN No. 0-07-019238-3), pp. 1–41]. Likewise, many different methods and processing sequences may be used to form the thermoplastic polyimide intermediate layer 156, with the claimed invention not being restricted to any particular manufacturing/deposition techniques. For example, the application of this material (initially in a liquid or semi-liquid state) to form the intermediate layer 156 on the selected component(s) within the printhead 80 may achieved using a number of known procedures including but not limited to (1) spin coating; (2) extrusion coating; (3) curtain coating; (4) extrusion/spin coating combinations; (5) roll coating; and (6) thermal lamination procedures which are generally known in the art for material deposition purposes. As previously indicated, the thermoplastic polyimide intermediate layer 156 may be applied and formed at any position between the orifice plate 104 and the substrate 82, and may likewise be applied at any stage during the printhead production process. In this regard, the reaction sequence associated with this step can be varied in accordance with the particular materials being processed and other parameters as determined by preliminary pilot testing.

In addition, the intermediate layer 156 of the invention may consist of either a single thermoplastic polyimide material or a mixture of more than one thermoplastic polyimide. However, the present invention shall not be restricted to the use of any particular number, types, or weight ratios in connection with thermoplastic polyimide blends that are employed to form the intermediate layer 156. The selection of any given blend will again be determined in accordance with routine preliminary testing. Representative thermoplastic polyimides which may be used in such a blend include the various thermoplastic polyimides listed above in connection with the single-polyimide intermediate layer 156. Furthermore, in certain cases as determined by pilot testing, blends containing (A) a thermoplastic polyimide (e.g. of the type listed above) combined with (B) a non-thermoplastic polyimide may be used to form the intermediate layer 156. These blends are useful in situations where particular operational parameters are desired which are best achieved through the use of a thermoplastic polyimide combined with a non-thermoplastic polyimide. However, it is important to emphasize that, in accordance with the present invention, these blends will need to have at least some thermoplastic polyimide therein in order to achieve the benefits listed above. This embodiment of the invention shall not be restricted to the use of any particular thermoplastic polyimides or non-thermoplastic polyimides. Non-thermoplastic polyimides which are suitable for this purpose are commercially available from E.I. DuPont de Nemours and Company of Wilmington, Del. (USA) and Hitachi of Japan. A representative and non-limiting thermoplastic/non-thermoplastic polyimide blend which may be used in fabricating the intermediate layer 156 will involve a mixture containing about 20–80% by weight of the LaRC™-SI product listed above (a thermoplastic polyimide) and about 20–80% by weight of a proprietary non-thermoplastic polyimide available from Hitachi under the designation "PL1708" (with both of these materials being used in respective amounts which add up to 100%).

As noted above, many benefits are achieved in the claimed invention when thermoplastic polyimides are used in connection with the intermediate layer 156. These materials (which are entirely distinctive compared with non-thermoplastic polyimides) offer the following key advantages over prior systems using other materials in connection with the intermediate layer 156: (1) an improved degree of adhesion between the intermediate layer 156 and the other adjacent components in the printhead 80 [e.g. the orifice plate 104 and substrate 82] which results in greater overall structural integrity; (2) improved thermal stability [e.g. heat-resistance] which avoids problems associated with deformation and premature separation of the printhead components; and (3) a greater degree of resistance to "solvation effects" caused by various ink compositions which, if not prevented, can cause chemical deterioration of the printhead 80 and its individual components. All of these benefits are achieved in the claimed invention through the use of thermoplastic polyimides as noted above.

An optional modification to the printhead 80 of FIG. 2 is schematically illustrated in FIG. 3. In most cases, the thermoplastic polyimides listed above are essentially "self-adhesive" in connection with adhesion of the intermediate layer 156 to the underlying substrate 82 (e.g. made of silicon) and the overlying orifice plate 104 (fabricated from the organic polymer compositions listed above). In this regard, separate adhesive materials within the printhead 80 will usually not be needed or desired. However, in certain cases as determined by preliminary pilot testing, a separate adhesive layer 200 may be employed between the top face 202 of the thermoplastic polyimide-containing intermediate layer 156 and the bottom surface 112 of the orifice plate 104. If adhesive materials are employed, they will preferably be most needed and used between the orifice plate 104 and the intermediate layer 156 as illustrated in FIG. 3. While the claimed invention shall not be restricted to the use of any particular adhesive compositions or thickness levels associated with the adhesive layer 200, optimum results are typically achieved when the adhesive layer 200 has a representative thickness $T_1$ (FIG. 3) of about 0.5–25 microns. Also, many different types of adhesives may be employed including uncured polyisoprene photoresist materials or similar compositions as outlined in U.S. Pat. No. 5,278,584 to Keefe et al. (incorporated herein by reference) and a material sold under the name PYRALUX® by E.I. DuPont de Nemours and Company of Wilmington, Del. (USA) which has a proprietary chemical composition. Likewise, a thin layer of another thermoplastic polyimide (which is different and more "adhesive" compared with the thermoplastic polyimide selected for use in the intermediate layer 156) can also be employed in connection with the adhesive layer 200. Regarding the thermoplastic polyimides that can be used in the adhesive layer 200, the list of materials provided above relative to the intermediate layer 156 is applicable. However, it is important to emphasize that the claimed printhead 80 and production method shall not be restricted to the use of adhesive materials in general which shall be considered optional.

The completed printheads 80 shown in FIGS. 2–3 which include the unique thermoplastic polyimide-containing intermediate layer 156 therein may then be used to produce a thermal inkjet cartridge unit of improved design and effectiveness. This is accomplished by securing the completed printhead 80 to the housing 12 of the inkjet cartridge unit 10 shown in FIG. 1. Attachment of the printhead 80 to the housing 12 may be accomplished in many different ways. However, in a preferred embodiment illustrated schematically in FIGS. 2–3, a portion of adhesive material 166 may again be applied to either the mounting frame 56 on the housing 12 and/or selected locations on the bottom surface 112 of the orifice plate 104. The orifice plate 104 is then adhesively affixed to the housing 12 (e.g. on the mounting frame 56 associated with the outwardly-extending printhead support structure 34 shown in FIG. 1). Representative adhesive materials suitable for this purpose include commercially available epoxy resin and cyanoacrylate adhesives known in the art. During the affixation process, the substrate 82 associated with the resistor assembly 96 is precisely positioned within the central cavity 50 as illustrated in FIGS. 2–3 so that the substrate 82 is located within the center of the mounting frame 56 (discussed above and shown in FIG. 1). In this manner, the ink flow passageways 100, 102 (FIGS. 2–3) are formed which enable ink materials to flow from the ink outlet port 54 within the central cavity 50 into the vaporization chambers 160 for expulsion from the cartridge unit 10 through the orifices 124 in the orifice plate 104. As a result of this assembly process, the printhead 80 shown in FIGS. 2–3 will be in fluid communication with the internal chamber 30 inside the housing 12 which contains the selected ink composition 174. It is again important to emphasize that the claimed printhead 80 and the benefits associated therewith are applicable to a wide variety of different thermal inkjet cartridge systems, with the present invention not being restricted to any particular cartridge designs or configurations. A representative cartridge system which may be employed in combination with the printhead 80 is disclosed in U.S. Pat. No. 5,278,584 to Keefe et al. and is commercially available from the Hewlett-Packard Company of Palo Alto, Calif. (USA)—product no. 51645A.

Finally, the basic production method associated with the invention represents an important development in ink cartridge technology which substantially improves the durability and structural integrity of the completed printhead 80 and ink cartridge unit 10. In a preferred embodiment, this method involves (1) providing a thermal inkjet printhead 80 as described above which includes a substrate 82 (e.g. made of silicon) having an upper surface 84 with at least one ink ejector 86 thereon, and an orifice plate 104 made of a non-metallic organic polymer positioned over and above the substrate 82, with the orifice plate 104 having a top surface 110, bottom surface 112, and a plurality of openings 124 therethrough; and (2) placing the intermediate layer 156 between the upper surface 84 of the substrate 82 having the ink ejector(s) 86 thereon and the bottom surface 112 of the orifice plate 104, with the intermediate layer 156 being comprised of at least one thermoplastic polyimide composition as discussed in detail above. The thermoplastic polyimide composition can involve a single compound or a blend of materials as previously noted. A representative system designed to produce optimum results will again utilize a thermoplastic polyimide intermediate layer 156 having an overall uniform thickness of about 0.5–50 microns. Preferred thermoplastic polyimides will have a glass transition temperature [$T_g$] (defined above) of less than about 310° C. (optimally about 75–290° C.). Also, representative materials suitable for producing the non-metallic orifice plate 104 will include polytetrafluoroethylene, non-thermoplastic polyimide, polymethylmethacrylate, polycarbonate, polyester, polyamide, polyethylene-terephthalate, and mixtures thereof. Implementation of the basic method associated with the invention may be accomplished as described above or in accordance with routine modifications to the foregoing process which achieve the same result. Thus, regardless of the steps which are used to produce the improved printhead structure, the claimed method represents an advance in the art of thermal inkjet technology.

In its broadest sense, the present invention generally involves the use of a thermoplastic polyimide-containing intermediate layer 156 between the orifice plate 104 and ink ejector-containing substrate 82 of the printhead 80. In a non-limiting but preferred embodiment, the upper face 202 of the intermediate layer 156 will be directly attached to the bottom surface 112 of the orifice plate 104 without any intervening structures or material layers therebetween. Likewise, in a non-limiting but preferred embodiment, the lower face 204 of the intermediate layer 156 will be directly attached to the upper surface 84 of the substrate 82 without any intervening structures or material layers therebetween. Whether the layer 156 constitutes a barrier structure used to define the ink flow passageways 100, 102 and vaporization chambers 160 (FIG. 2) in the printhead 80 or functions as a layer of adhesive material 200 designed to secure the printhead 80 together, the unique characteristics of thermoplastic polyimides within the completed printhead 80 enable numerous benefits to be achieved. These benefits again include: (1) an improved degree of adhesion regarding attachment of the internal printhead components to each other which leads to a greater level of overall structural integrity; (2) improved thermal stability and heat-resistance which avoids printhead deformation/delamination problems; (3) an enhanced level of resistance to the deterioration of printhead components caused by the solvent characteristics of ink materials; and (4) the maintenance of a high level of print quality over the life of the cartridge unit 10 which is capable of providing long-term service without the problems listed above.

Having herein described preferred and optimum embodiments of the present invention, it is anticipated that modifications may be made thereto by individuals skilled in the relevant art which nonetheless remain within the scope of the invention. For example, the invention shall not be limited to any particular manufacturing methods, dimensions, and other production parameters in connection with the claimed printhead(s), ink cartridge(s), and method(s) unless otherwise indicated herein. Accordingly, the invention shall only be construed in connection with the following claims.

The invention that is claimed is:

1. A printhead for use in an ink cartridge comprising:

a substrate comprising an upper surface, said upper surface comprising at least one ink ejector thereon;

an orifice plate member positioned over and above said substrate, said orifice plate member being comprised of a non-metallic organic polymer composition, said orifice plate member further comprising a top surface, a bottom surface, and at least one opening passing through said orifice plate member; and an intermediate layer positioned between said orifice plate member and said substrate, said intermediate layer being comprised of at least one thermoplastic polyimide composition and at least one non-thermoplastic polyimide composition.

2. The printhead of claim 1 wherein said substrate is comprised of silicon.

3. The printhead of claim 1 further comprising a layer of at least one adhesive composition positioned between said intermediate layer and said orifice plate member.

4. The printhead of claim 1 wherein said thermoplastic polyimide composition used to produce said intermediate layer has a glass transition temperature of less than about 310° C.

5. The printhead of claim 1 wherein said thermoplastic polyimide composition used to produce said intermediate layer has a glass transition temperature of about 75–290° C.

6. The printhead of claim 1 wherein said intermediate layer has a thickness of about 0.5–50 microns.

7. A method for separating an orifice plate member from a substrate in an ink cartridge printhead comprising:

a substrate comprising an upper surface, said upper surface comprising at least one ink ejector thereon; and an orifice plate member positioned over and above said substrate, said orifice plate member being comprised of a non-metallic organic polymer composition, said orifice plate member further comprising a top surface, a bottom surface, and at least one opening passing through said orifice plate member; and placing an intermediate layer between said bottom surface of said orifice plate member and said upper surface of said substrate, said intermediate layer being comprised of at least one thermoplastic polyimide composition and at least one non-thermoplastic polyimide composition.

8. The method of claim 7 wherein said substrate in said printhead is comprised of silicon.

9. The method of claim 7 wherein said thermoplastic polyimide composition used to produce said intermediate layer in said printhead has a glass transition temperature of less than about 310° C.

10. The method of claim 7 wherein said thermoplastic polyimide composition used to produce said intermediate layer in said printhead has a glass transition temperature of about 75–290° C.

11. The printhead of claim 7 wherein said intermediate layer has a thickness of about 0.5–50 microns.

* * * * *